US011313249B2

(12) United States Patent
Ishida et al.

(10) Patent No.: US 11,313,249 B2
(45) Date of Patent: Apr. 26, 2022

(54) ROTOR BLADE AND AXIAL-FLOW ROTARY MACHINE

(71) Applicant: MITSUBISHI HEAVY INDUSTRIES, LTD., Tokyo (JP)

(72) Inventors: Tomohiro Ishida, Tokyo (JP); Toshifumi Kanno, Tokyo (JP); Hikaru Kurosaki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1 day.

(21) Appl. No.: 17/117,938

(22) Filed: Dec. 10, 2020

(65) Prior Publication Data

US 2021/0215067 A1 Jul. 15, 2021

(30) Foreign Application Priority Data

Jan. 10, 2020 (JP) ..... JP2020-002673

(51) Int. Cl.
*F01D 25/24* (2006.01)
*F01D 11/08* (2006.01)

(52) U.S. Cl.
CPC ..... *F01D 25/24* (2013.01); *F01D 11/08* (2013.01); *F05D 2220/30* (2013.01); *F05D 2240/60* (2013.01)

(58) Field of Classification Search
CPC ..... F01D 25/24; F01D 11/08; F01D 11/122; F01D 5/225; F05D 2220/30; F05D 2240/60; F05D 2240/80; F05D 2240/307; F05D 2250/14; F05D 2250/24
See application file for complete search history.

(56) References Cited

U.S. PATENT DOCUMENTS 4,076,455 A * 2/1978 Stargardter ..... F01D 5/3053 416/500
4,623,298 A * 11/1986 Hallinger ..... F01D 5/225 415/174.4
4,925,365 A * 5/1990 Crozet ..... F01D 9/04 415/173.6
5,154,581 A * 10/1992 Borufka ..... F01D 5/225 416/190

(Continued)

FOREIGN PATENT DOCUMENTS

EP 2 385 215 11/2011
JP 2008-32013 2/2008

(Continued)

*Primary Examiner* — Igor Kershteyn
(74) *Attorney, Agent, or Firm* — Wenderoth, Lind & Ponack, L.L.P.

(57) ABSTRACT

A rotor blade attached to a rotor shaft rotatable around an axis includes: a blade body extending in a radial direction with respect to the axis and having a blade-shaped cross section orthogonal to the radial direction; a shroud provided at an end of the blade body on a radial outer side, and a seal fin protruding from the shroud toward an outer circumferential side, and the seal fin includes: a seal fin body extending in a plate shape in a circumferential direction; and a reinforcing portion provided on at least one plate surface of the seal fin body to increase a thickness of the seal fin, the reinforcing portion gradually increasing in dimension in the radial direction toward the center in the circumferential direction.

11 Claims, 11 Drawing Sheets

(56) References Cited

U.S. PATENT DOCUMENTS

| | | | | |
|---|---|---|---|---|
| 5,238,364 | A * | 8/1993 | Kreitmeier | F01D 11/127 415/173.1 |
| 5,290,144 | A * | 3/1994 | Kreitmeier | F01D 11/08 415/173.1 |
| 5,758,487 | A * | 6/1998 | Salt | F01D 5/084 415/114 |
| 6,913,445 | B1 * | 7/2005 | Beddard | F01D 5/225 415/173.6 |
| 2002/0189229 | A1 * | 12/2002 | Hidaka | C21D 9/0068 60/39.182 |
| 2008/0025841 | A1 | 1/2008 | Norton et al. | |
| 2008/0038116 | A1 | 2/2008 | Zemitis et al. | |

FOREIGN PATENT DOCUMENTS

| | | |
|---|---|---|
| JP | 2008-38910 | 2/2008 |
| JP | 2010-285878 | 12/2010 |
| JP | 6124787 | 5/2017 |

* cited by examiner

ROTOR BLADE AND AXIAL-FLOW ROTARY MACHINE

CROSS-REFERENCE TO RELATED APPLICATIONS

This application claims the benefit of priority to Japanese Patent Application Number 2020-002673 filed on Jan. 10, 2020. The entire contents of the above-identified application are hereby incorporated by reference.

TECHNICAL FIELD

The present disclosure relates to a rotor blade and an axial-flow rotary machine.

RELATED ART

A turbine, which is a type of axial-flow rotary machine, includes a rotor shaft, a plurality of rotor blades arranged on an outer circumferential surface of the rotor shaft, and a cylindrical easing that covers the rotor shaft and the rotor blades from the outer circumferential side. A specific example of the rotor blade used in such a turbine is disclosed in JP 2008-038910 described below. The rotor blade described in JP 2008-038910 A includes a blade root attached to the rotor shaft, a blade body that extends from the blade root outward in the radial direction, a shroud provided on an end of the blade body on the radial outer side, and a plate-like seal fin that protrudes from the shroud further outward in the radial direction.

The blade body has a blade-shaped cross section when viewed from the radial direction. The shroud is shaped like a plate that extends in a plane intersecting the blade body. The seal fin is provided to prevent leakage of fluid on the outer circumferential side of the shroud. In addition, in the rotor blade described in JP 2008-038910 A, in order to reduce a load generated due to the centrifugal force associated with the rotation of the rotor shaft, a lightening cavity is formed in the shroud.

SUMMARY

However, when the weight of the shroud is reduced as described above, the structural strength of the shroud itself deteriorates, thereby relatively increasing the load applied to the seal fin. As a result, excessive deformation or damage may occur in the seal fin.

An object of the present disclosure is to solve the problems described above, and provide a rotor blade that is more lightweight and has a higher strength and an axial-flow rotary machine provided with the rotor blade.

To attain the above-described object, a rotor blade according to the present disclosure is a rotor blade attached to a rotor shaft rotatable around an axis, the rotor blade includes: a blade body extending in a radial direction with respect to the axis, the blade body having a blade-shaped cross section orthogonal to the radial direction; a shroud provided at an end of the blade body on a radial outer side; and a seal fin protruding from the shroud toward an outer circumferential side, and the seal in has: a seal fin body extending in a plate shape in a circumferential direction; and a reinforcing portion provided on at least one plate surface of the seal fin body so as to increase a thickness of the seal fin, the reinforcing portion gradually increasing in dimension in the radial direction toward the center in the circumferential direction.

According to the present disclosure, a rotor blade that is more lightweight and has a higher strength and an axial-flow rotary machine provided with the rotor blade can be provided.

BRIEF DESCRIPTION OF DRAWINGS

The disclosure will be described with reference to the accompanying drawings, wherein like numbers reference like elements.

DESCRIPTION OF EMBODIMENTS

First Embodiment

Configuration of Gas Turbine

Hereinafter, a gas turbine 10, which is an axial-flow rotary machine according to a first embodiment of the present disclosure, and a rotor blade 50 will be described with reference to FIGS. 1 to 4. Note that the configuration described hereinafter can be suitably applied not only to the gas turbine 10, but also to other axial-flow rotary machines including steam turbines and axial-flow compressors.

Figure 1:
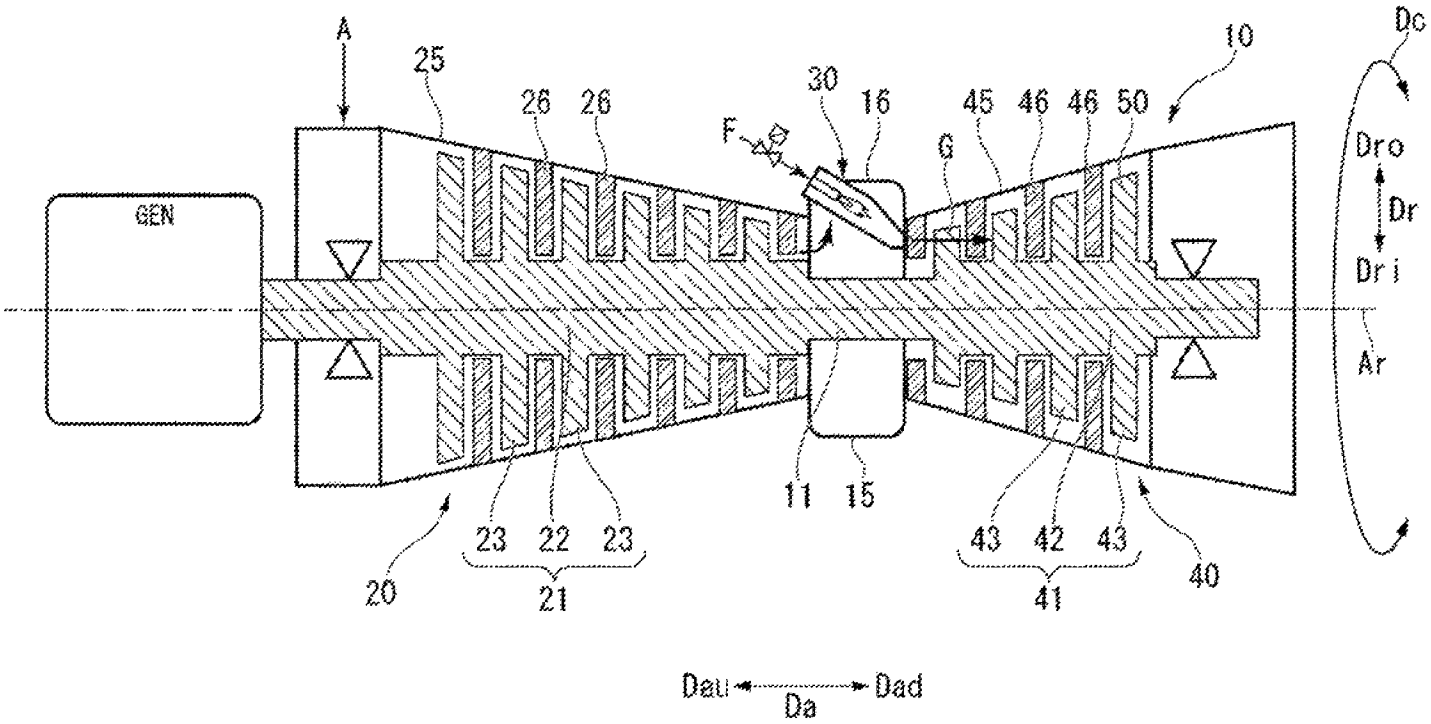
FIG. 1 is a schematic view illustrating the configuration of a gas turbine that is an axial-flow rotary machine according to a first embodiment of the present disclosure.

As illustrated in FIG. 1, the gas turbine 10 includes a compressor 20 that compresses air A, a combustor 30 that generates combustion gas G by combustion of fuel F in the air A compressed by the compressor 20, and a turbine 40 driven by the combustion gas G.

The compressor 20 includes a compressor rotor 21 that rotates around an axis Ar, a compressor casing 25 that covers the compressor rotor 21, and a plurality of stator vane rows 26. The turbine 40 includes a turbine rotor 41 that rotates around the axis Ar, a turbine casing 45 that covers the turbine rotor 41, and a plurality of stator vane rows 46. Note that in the following, it is assumed that a direction in which the axis Ar extends is an axial direction Da, a circumferential direction around this axis Ar is a circumferential direction Dc, and a direction orthogonal to the axis Ar is a radial direction Dr. In addition, it is assumed that, one side in the axial direction Da is an axial upstream side Dau, and an opposite side to the one side is an axial downstream side Dad. In addition, it is assumed that, in the radial direction Dr, a side near the axis Ar is a radial inner side Dri, and a side opposite to the side near the axis Ar is a radial outer side Dro.

The compressor 20 is disposed on the axial upstream side Dau with respect to the turbine 40. The compressor rotor 21 and the turbine rotor 41 are located on the same axis Ar, and connected to each other to form a gas turbine rotor 11. For example, a rotor of a generator GEN is connected to this gas turbine rotor 11. The gas turbine 10 further includes an intermediate casing 16 disposed between the compressor easing 25 and the turbine casing 45. The combustor 30 is attached to the intermediate casing 16. The compressor casing 25, the intermediate casing 16, and the turbine easing 45 are connected with each other to form a gas turbine casing 15.

The compressor rotor 21 includes a rotor shaft 22 extending in the axial direction Da around the axis Ar, and a plurality of rotor blade rows 23 attached to this rotor shaft 22. The plurality of rotor blade rows 23 are aligned in the axial direction Da. Each of the rotor blade rows 23 includes a plurality of rotor blades arranged in the circumferential direction Dc. One of the plurality of stator vane rows 26 is disposed on the axial downstream side Dad of each of the rotor blade rows 23. Each of the stator vane rows 26 is provided on the inner side of the compressor casing 25. Each of the stator vane rows 26 includes a plurality of stator vanes arranged in the circumferential direction Dc.

The turbine rotor 41 includes a rotor shaft 42 extending in the axial direction Da around the axis Ar and a plurality of rotor blade rows 43 attached to the rotor shaft 42. The plurality of rotor blade rows 43 are aligned in the axial direction Da. Each of the rotor blade rows 43 includes a plurality of rotor blades 50 arranged in the circumferential direction Dc. One of the plurality of stator vane rows 46 is disposed on the axial upstream side Dau of each of the plurality of rotor blade rows 43. Each of the stator vane rows 46 is provided on the inner side of the turbine casing 45. Each of the stator vane rows 46 includes a plurality of stator vanes arranged in the circumferential direction Dc.

The compressor 20 sucks the air A and compresses it. The air that has been compressed, that is, compressed air flows into the combustor 30 through the intermediate casing 16. The fuel F is supplied to the combustor 30 from the outside. The combustor 30 generates combustion gas G by combusting the fuel F in the compressed air. The combustion gas G flows into the turbine casing 45 and rotates the turbine rotor 41. Rotation of the turbine rotor 41 causes the generator GEN to generate power.

Configuration of Rotor Blade

Figure 2:
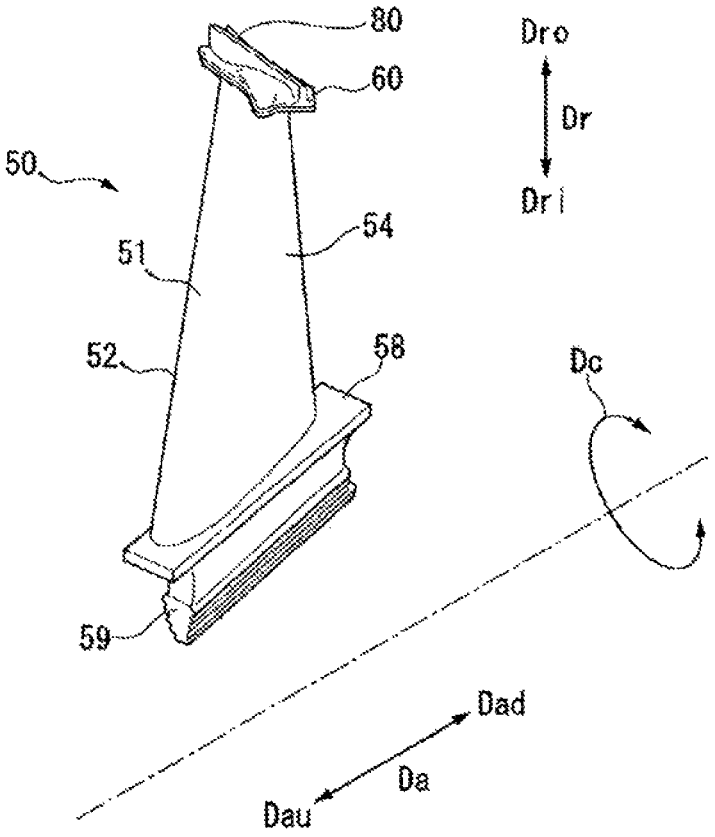
FIG. 2 is a perspective view illustrating the configuration of a rotor blade according to the first embodiment of the present disclosure.
Figure 3:
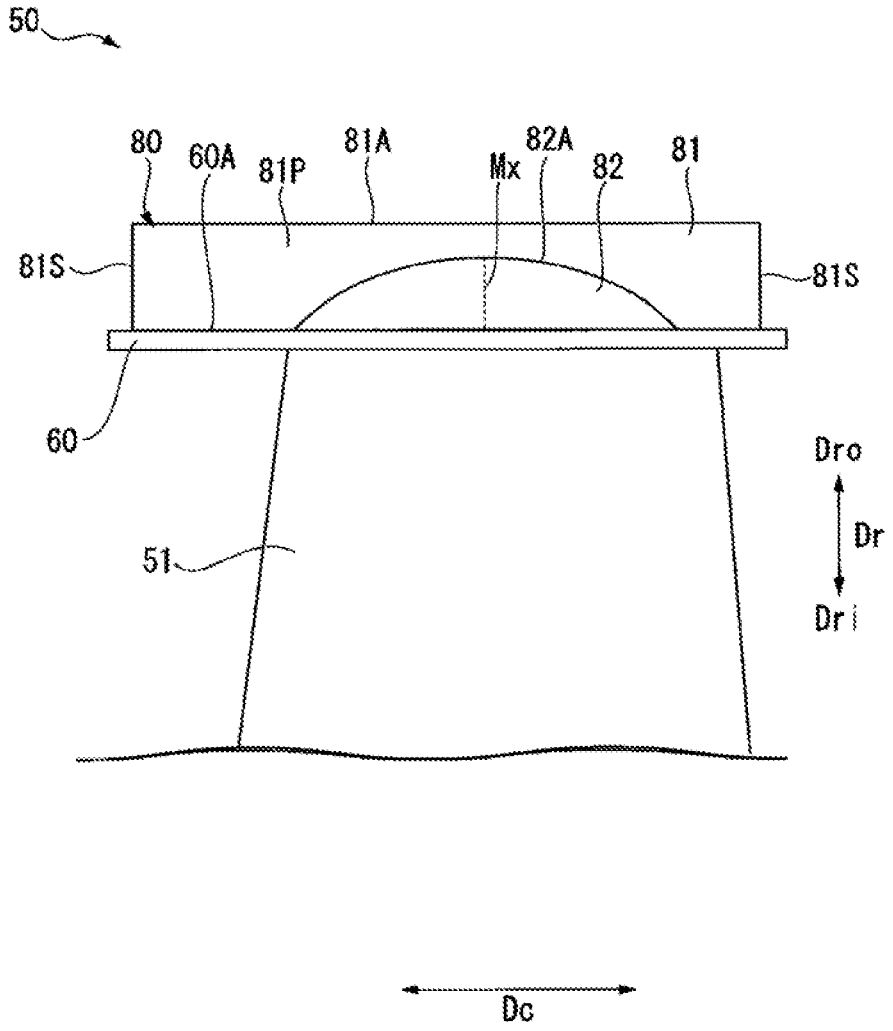
FIG. 3 is a view illustrating a shroud and a seal fin according to the first embodiment of the present disclosure when viewed from the axial direction.

Next, the configuration of the rotor blade 50 will be described in detail with reference to FIGS. 2 to 4. As illustrated in FIG. 2, the rotor blade 50 includes a blade body 51 that is blade-shaped, a shroud 60, a seal fin 80, a platform 58, and a blade root 59. The blade body 51 extends in the radial direction Dr. The cross section of the blade body 51 is blade-shaped. Note that this cross section is the cross section of the blade body 51 perpendicular to the radial direction Dr.

Figure 4:
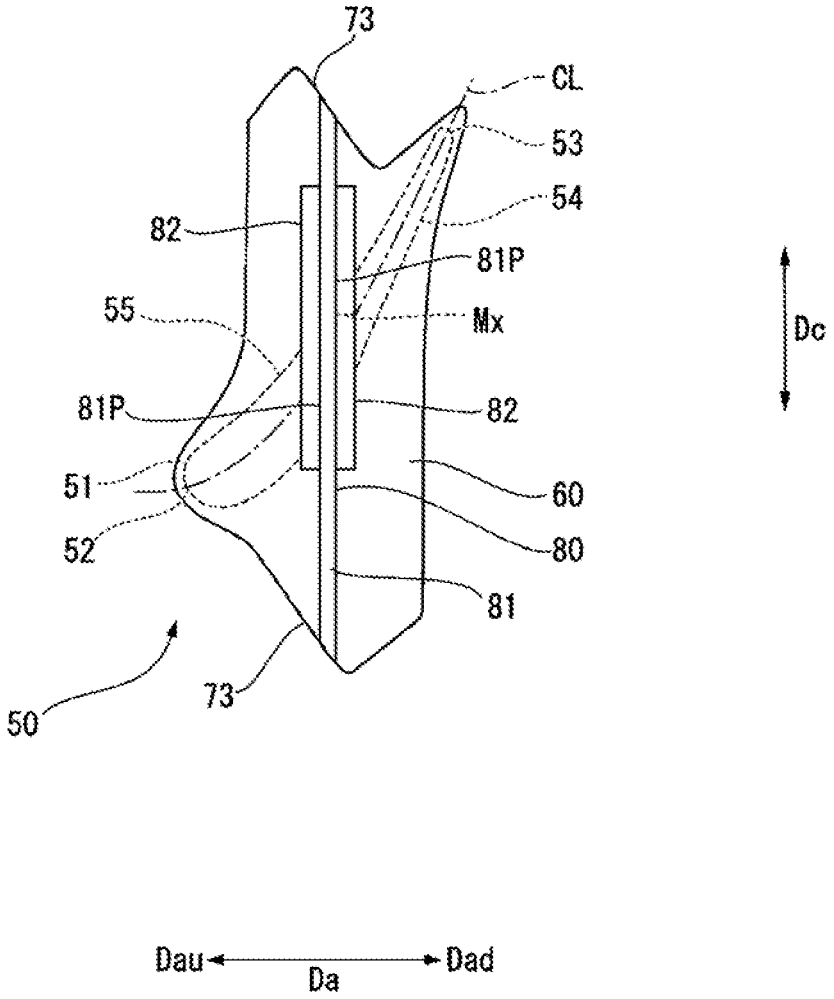
FIG. 4 is a view illustrating the shroud and the seal fin according to the first embodiment of the present disclosure when viewed from the radial outer side.

As illustrated in FIG. 2 or FIG. 4, the blade body 51 includes a leading edge 52, a trailing edge 53, a negative pressure surface (posterior surface) 54 that is a convex surface, and a positive pressure surface (anterior surface) 55 that is a concave surface. The leading edge 52 and the trailing edge 53 are present in a connecting portion of the negative pressure surface 54 and the positive pressure surface 55. All of the leading edge 52, the trailing edge 53, the negative pressure surface 54, and the positive pressure surface 55 extend in a direction having a directional component of the radial direction Dr. The leading edge 52 is located on the axial upstream side Dau with respect to the trailing edge 53.

As illustrated in FIG. 2, the platform 58 is provided at an end of the blade body 51 on the radial inner side Dri. The platform 58 is shaped like a plate that extends in a plane having a directional component perpendicular to the radial direction Dr. The blade root 59 is a structure for attaching the rotor blade 50 to the rotor shaft 42. The blade root 59 is provided on the radial inner side Dri of the platform 58.

The shroud 60 and the seal fin 80 are provided on an end of the blade body 51 on the radial outer side Dro. The shroud 60 is shaped like a plate that extends in a plane having a directional component perpendicular to the radial direction Dr.

As illustrated in FIG. 4, the shroud 60 has contact surfaces 73 on both sides of the circumferential direction Dc. The contact surface 73 of the shroud 60 of one rotor blade 50 and the contact surface 73 of the shroud 60 of another rotor blade 50 adjacent to the one rotor blade 50 in the circumferential direction Dc are opposed to and in contact with each other. Note that the contact surface 73 described herein is a surface of the shroud 60 at each circumferential end on the axial upstream side Dau, and a surface on the axial downstream side Dad does not contact the adjacent shroud 60.

The seal fin 80 is provided on an end surface (shroud outer circumferential surface 60A) of the shroud 60 on the radial outer side Dro. As illustrated in FIGS. 3 and 4, the seal fin 80 includes a seal fin body 81 that protrudes from the shroud outer circumferential surface 60A toward the radial outer side, and reinforcing portions 82 integrally provided on a pair of surfaces (plate surfaces 81P) of the seat fin body 81, which face the axial direction Da.

The seal fin body 81 is shaped like a plate that extends on the shroud outer circumferential surface 60A in the circumferential direction Dc and protrudes toward the radial outer side Dro. Edges of the seal fin body 81 on both sides in the circumferential direction Dc each are a fin side surface 81S. An edge of the seal fin body 81 on the radial outer side Dro is a fin outer circumferential surface 81A. The fin side surfaces 81S and the fin outer circumferential surface 81A are orthogonal to each other. In other words, the seal fin body 81 is substantially rectangular when viewed from the axial direction Da. More specifically, the seal fin body 81 has an arc shape extending in the circumferential direction Dc.

The reinforcing portion 82 is provided on at least one of the pair of plate surfaces 81P of the seal fin body 81. In the present embodiment, as illustrated in FIGS. 3 and 4, each of the pair of plate surfaces 81P is provided with the reinforcing portion 82. The reinforcing portion 82 protrudes from the plate surface 81P in the axial direction Da so as to increase the thickness (dimension in the axial direction Da) of the seal fin body 81. An end surface (reinforcing portion outer circumferential surface 82A) of the reinforcing portion 82 on the radial outer side Dro is curved so as to protrude toward the radial outer side Dro. As a result, the dimension of the reinforcing portion 82 in the radial direction Dr gradually increases toward the center of the reinforcing portion 82 in the circumferential direction Dc. Note that in the present embodiment, the dimension of the reinforcing portion 82 in the circumferential direction Dc is smaller than the dimension of the seal fin body 81 in the circumferential direction Dc.

In addition, the reinforcing portion outer circumferential surface 82A is located closer to the radial inner side Dri than the fin outer circumferential surface 81A. In other words, the portion including the fin outer circumferential surface 81A of the seal fin body 81 on the radial outer side Dro has a smaller thickness (dimension in the axial direction Da) than the portion including the reinforcing portion 82 on the radial inner side Dri.

The edge of the reinforcing portion 82 on the radial inner side Dri is integrally connected to the shroud outer circumferential surface 60A. In other words, the reinforcing portion 82 is integrally provided on the plate surface 81P of the seal fin body 81 and is also integrally provided on the shroud outer circumferential surface 60A. In this case, the reinforcing portion 82 is preferably formed from the same material as that of the seal fin body 81 and the shroud 60. On the contrary, only the reinforcing portion 82 may be formed from a material that is different from the material of the seal fin body 81 and the shroud 60. In the present embodiment, the reinforcing portion 82 is a solid plate as an example. However, the reinforcing portion 82 may be a grid-shaped hollow member including a truss structure or a lattice structure.

As illustrated in FIG. 4, in the present embodiment, the reinforcing portions 82 are located at the same position in the circumferential direction Dc between the pair of plate surfaces 81P. More specifically, the reinforcing portions 82 are located so as to overlap the blade body 51 when viewed from the radial direction Dr. More desirably, the largest portion (largest portion Mx) of at least one of the pair of reinforcing portions 82 in the radial direction Dr intersects a camber line CL of the blade body 51. In the example in FIG. 4, the largest portions Mx of the reinforcing portions 82 on the axial downstream side Dad in the axial direction Da intersect the camber line CL.

The thicknesses (dimensions in the axial direction Da) of the reinforcing portions 82 are the same. In addition, the thickness of each of the reinforcing portions 82 is constant over the entire range in the circumferential direction Dc. Note that "same" and "constant" described herein refer to a substantially same or constant state, and allow manufacturing errors and design tolerances.

Operational Effects

Next, the operation of the gas turbine 10 and the behavior of the rotor blade 50 according to the present embodiment will be described. To drive the gas turbine 10, first, the gas turbine rotor 11 is rotated by an external power source (including an electric motor or the like). As the gas turbine rotor 11 rotates, the compressor 20 generates compressed air. The combustor 30 generates high-temperature, high-pressure combustion gas by incorporating the fuel F to the compressed air and causing the fuel and air to combust. The turbine 40 is rotationally driven by the combustion gas G. The gas turbine 10 is operated by continuous occurrence of the process described above.

Here, when the gas turbine rotor 11 (the rotor shaft 22) rotates, a centrifugal force toward the radial outer side Dro is applied to the rotor blade 50. Due to the centrifugal force, a bending moment starting from the boundary between the shroud 60 and the blade body 51 toward the radial outer side Dro occurs in the shroud 60. When the stress is applied to the seal fin 80, the seal fin 80 may be excessively deformed. When the seal fin 80 is excessively deformed, the amount of leaked gas located closer to the radial outer side Dro than the shroud 60 is increased, which may hinder the stable operation of the gas turbine 10.

However, in the configuration described above, the seal fin body 81 is provided with the reinforcing portions 82. The dimension of the reinforcing portion 82 in the radial direction Dr gradually increases toward the center in the circumferential direction Dc. The center portion of the seal fin body 81 in the circumferential direction Dc intersects the blade body 51. In other words, the largest bending moment occurs in a section where the seal fin body 81 and the blade body 51 overlap each other. With the configuration described above, the portion of the seal fin 80, where the bending moment is the largest, can be preferentially reinforced to receive most of the bending moment by the reinforcing portion 82. As a result, deformation of the seal fin can be suppressed.

Furthermore, as compared with the configuration in which the dimension of the reinforcing portion 82 in the radial direction Dr is constant over the entire range of the seal fin body 81 in the circumferential direction Dc, the thickness of the reinforcing portion 82 can be reduced, thereby suppressing the weight of the entire rotor blade 50. This can reduce the centrifugal force applied to the rotor blade 50, thereby extending the life of the rotor blade 50.

Furthermore, with the configuration described above, the largest portion Mx of the reinforcing portion 82 is located at the section where the seal fin 80 and the blade body 51 intersect each other. As a result, the portion of the seal fin 80, where the bending moment is the largest, can be preferentially reinforced to receive most of the bending moment by the reinforcing portion 82. Thus, deformation of the seal fin 80 can be further suppressed.

In addition, with the configuration described above, the end surface (the reinforcing portion outer circumferential surface 82A) of the reinforcing portion 82 on the radial outer side Dro is curved so as to protrude toward the radial outer side Dro. Thus, the thickness of the reinforcing portion 82 on both ends in the circumferential direction Dc can be reduced. As a result, an increase in weight of the rotor blade 50 due to the reinforcing portion 82 can be suppressed. In addition, since the end surface (the reinforcing portion outer circumferential surface 82A) is curved, for example, as compared with the case where a corner portion is formed on the end surface, localized stress concentration in the reinforcing portion 82 can be suppressed.

In addition, with the configuration described above, the end surface of the reinforcing portion 82 on the radial inner side Dri is integrally connected to the surface (shroud outer circumferential surface 60A) of the shroud 60 on the radial outer side Dro. In other words, the reinforcing portion 82 and the shroud 60 are integrally formed. As a result, the load applied to the shroud 60 due to the centrifugal force can be received more stably.

In addition, with the configuration described above, the dimension of the reinforcing portion 82 in the circumferential direction Dc is smaller than the dimension of the seal fin body 81 in the circumferential direction Dc. Thus, the thickness of the reinforcing portion 82 on both ends in the circumferential direction Dc can be further reduced. As a result, it is possible to further suppress the increase in weight of the rotor blade 50 due to the reinforcing portion 82.

Furthermore, with the configuration described above, an end surface (reinforcing portion outer circumferential surface 82A) of the reinforcing portion 82 on the radial outer side Dro is located closer to the radial inner side Dri than the end surface (fin outer circumferential surface 81A) of the seal fin body 81 on the radial outer side Dro. As a result, a portion of the seal fin body 81 on the radial outer side Dro with respect to the reinforcing portion 82 is thinner than the other portion. In other words, the portion functions as a thin cutting blade. Therefore, for example, when an abradable seal (free-cutting material) is brought into contact with the radial outer side of the seal fin body 81, the cutting ability of the seal fin body 81 for the free-cutting material can be further increased. As a result, it is possible to reduce the possibility that the melted free-cutting material adheres to the seal fin body 81, or cutting becomes unstable.

The first embodiment of the present invention has been described above. Note that various changes and modifications can be made to the above-described configuration without departing from the subject matter of the present disclosure.

First Modified Example

Figure 5:
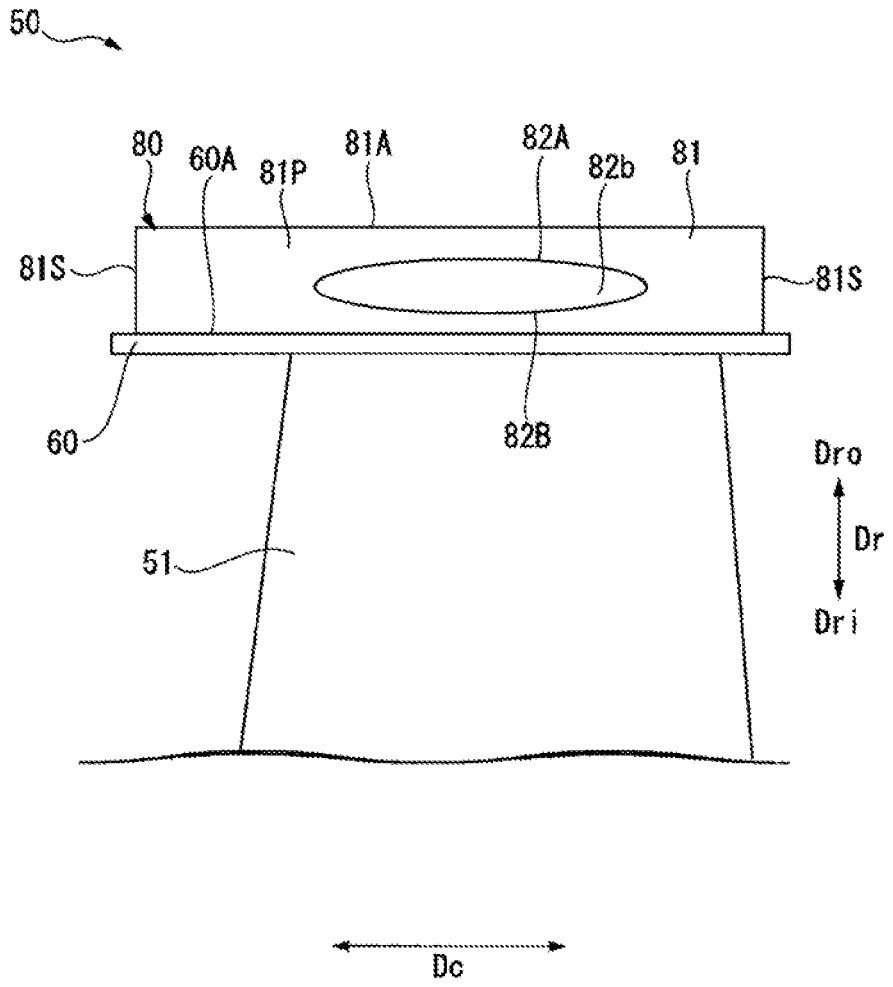
FIG. 5 is a view illustrating a shroud and a seal fin according to a first modified example of the first embodiment of the present disclosure when viewed from the axial direction.

For example, in the first embodiment described above, the edge of the reinforcing portion 82 on the radial inner side Dri is integrally connected to the shroud outer circumferential surface 60A. However, as illustrated in FIG. 5, a gap extending, in the radial direction Dr may be formed between an end surface (reinforcing portion inner circumferential surface 82B) of the reinforcing portion 82*b* on the radial inner side Dri and the shroud outer circumferential surface 60A. In addition, in the example illustrated in this figure, the reinforcing portion inner circumferential surface 82B is curved so as to protrude toward the radial inner side Dri.

With the configuration described above, the end surface (reinforcing portion inner circumferential surface 82B) of the reinforcing portion 82*b* on the radial inner side Dri is curved so as to protrude toward the radial inner side Dri. Thus, the thickness of the reinforcing portion 82*b* on both ends in the circumferential direction Dc can be reduced. As a result, it is possible to further reduce an increase in weight of the rotor blade due to the reinforcing portion 82*b*. In addition, since the end surface (the reinforcing portion inner circumferential surface 82B) is curved, for example, as compared with the case where a corner portion is formed on the end surface, localized stress concentration in the reinforcing portion 82*b* can be further suppressed.

Second Modified Example

Figure 6:
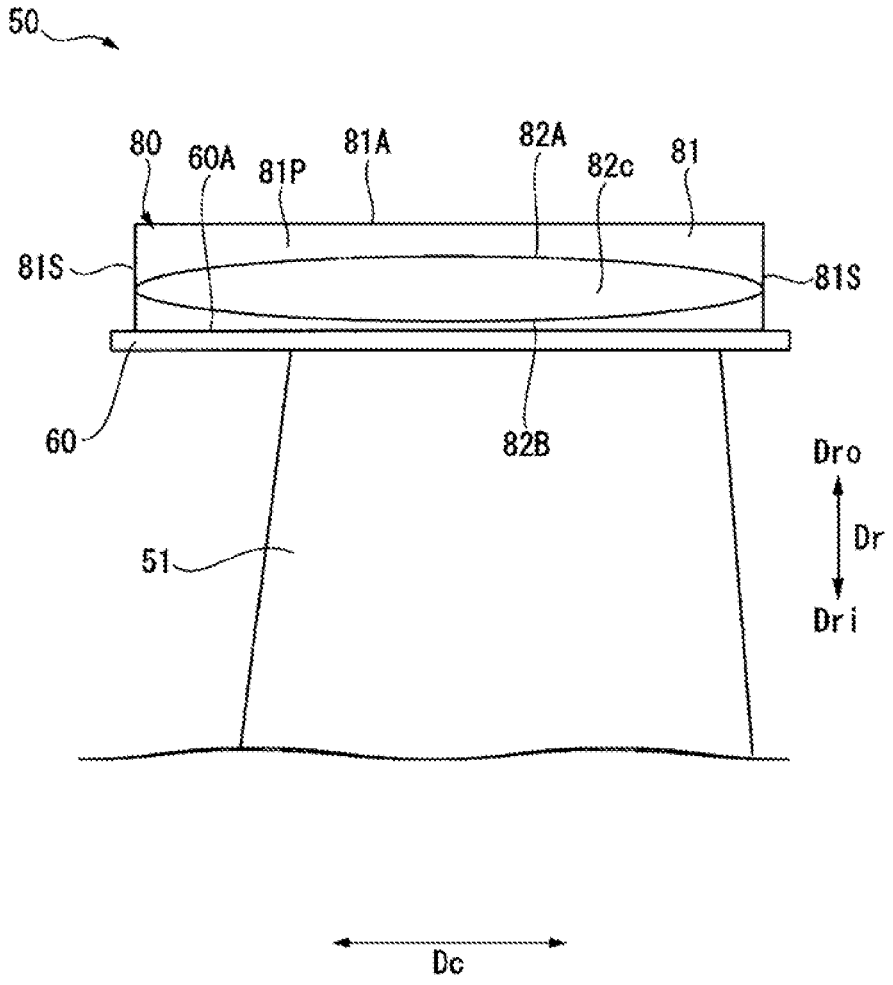
FIG. 6 is a view illustrating a shroud and a seal fin according to a second modified example of the first embodiment of the present disclosure when viewed from the axial direction.

Furthermore, in the first embodiment described above, the dimension of the reinforcing portion 82 in the circumferential direction Dc is smaller than the dimension of the seal fin body 81 in the circumferential direction Dc. However, as illustrated in FIG. 6, the dimension of a reinforcing portion 82*c* in the circumferential direction Dc may be the same as the dimension of the seal fin body 81 in the circumferential direction Dc. In other words, the reinforcing portion 82*c* extends over the entire range of the plate surface 81P of the seal body 81 in the circumferential direction Dc.

With the configuration described above, the seal fin body 81 can be stably reinforced over the entire extension length of the seal fin body 81. As a result, excessive deformation of the seal fin 80 can be further suppressed.

Third Modified Example

Figure 7:
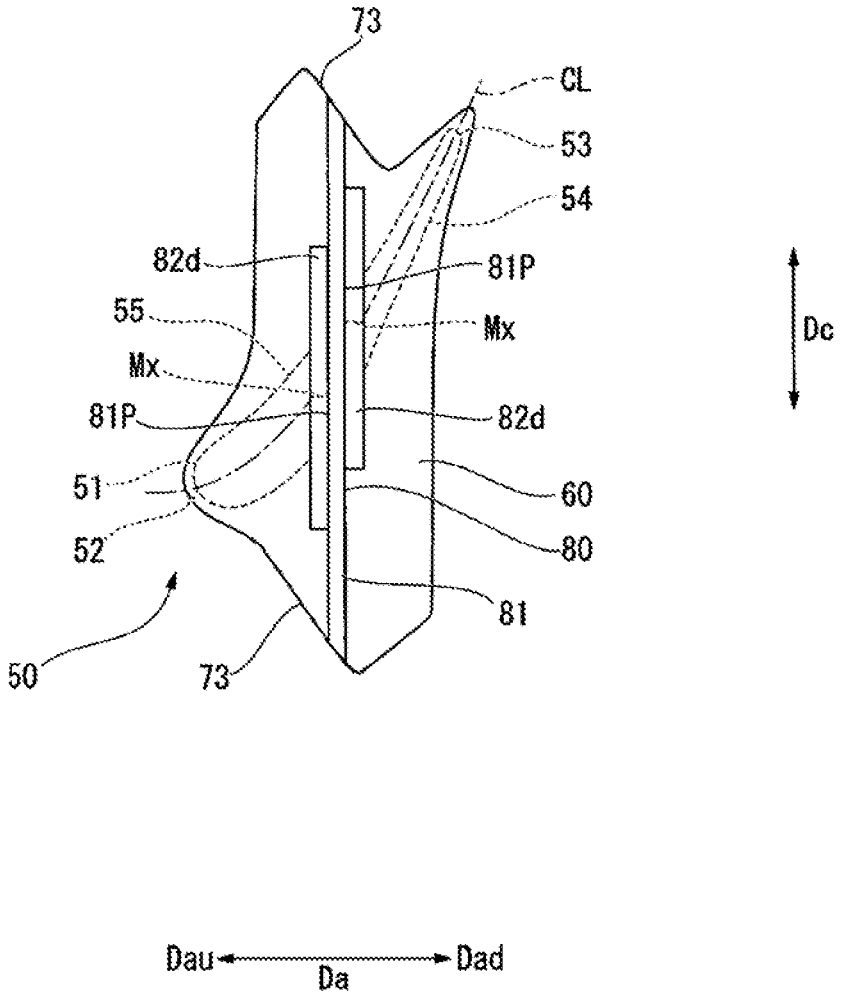
FIG. 7 is a view illustrating a shroud and a seal fin according to a third modified example of the first embodiment of the present disclosure when viewed from the radial outer side.

In addition, in the first embodiment described above, on both sides of the seal fin body 81 in the thickness direction (that is, the axial direction Da), the pair of reinforcing portions 82 are located at the same position in the circumferential direction Dc. However, as illustrated in FIG. 7, a pair of reinforcing portions 82*d* may be located at different positions in the circumferential direction Dc. More specifically, these reinforcing portions 82*d* are provided at positions overlapping the blade body 51 when viewed from the radial direction Dr. Furthermore, the portions having the largest dimension (largest portions Mx) in the radial direction Dr in the pair of reinforcing portions 82*d* intersect the camber line CL of the blade body 51.

With the configuration described above, the largest portions Mx of the pair of reinforcing portions 82*d* are located at the section where the seal fin 80 and the blade body 51 intersect each other. Thus, the portion of the seal fin 80, where the bending moment is the largest, can be preferentially reinforced to receive most of the bending moment by the reinforcing, portions 82*d*. Thus, deformation of the seal fin 80 can be further suppressed.

Fourth Modified Example

Figure 8:
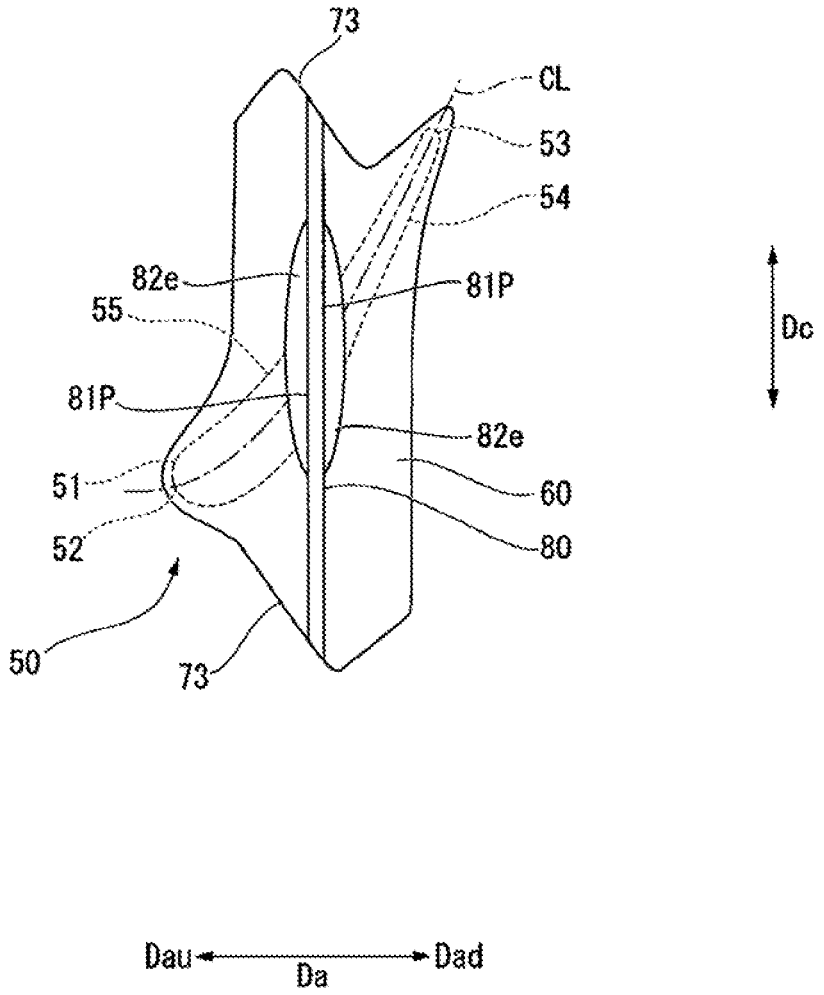
FIG. 8 is a view illustrating a shroud and a seal fin according to a fourth modified example of the first embodiment of the present disclosure when viewed from the radial outer side.

In the first embodiment described above, the thickness (that is, the dimension in the axial direction Da) of the reinforcing portion 82 is constant over the entire range in the circumferential direction Dc. However, as illustrated in FIG. 8, the thickness of the reinforcing portion 82*e* may be configured to gradually increase toward the center in the circumferential direction Dc. In other words, the reinforcing portion 82*e* protrudes from the plate surface 81P in a curved shape having an apex at the center in the circumferential direction Dc.

With the configuration described above, as compared with the configuration in which the thickness of the reinforcing portion 82*e* is constant over the entire range in the circumferential direction Dc, the thickness of the reinforcing portion 82*e* can be further reduced, thereby suppressing the weight of the entire rotor blade 50. This can reduce the centrifugal force applied to the rotor blade 50, thereby extending the life of the rotor blade 50.

Second Embodiment

Figure 9:
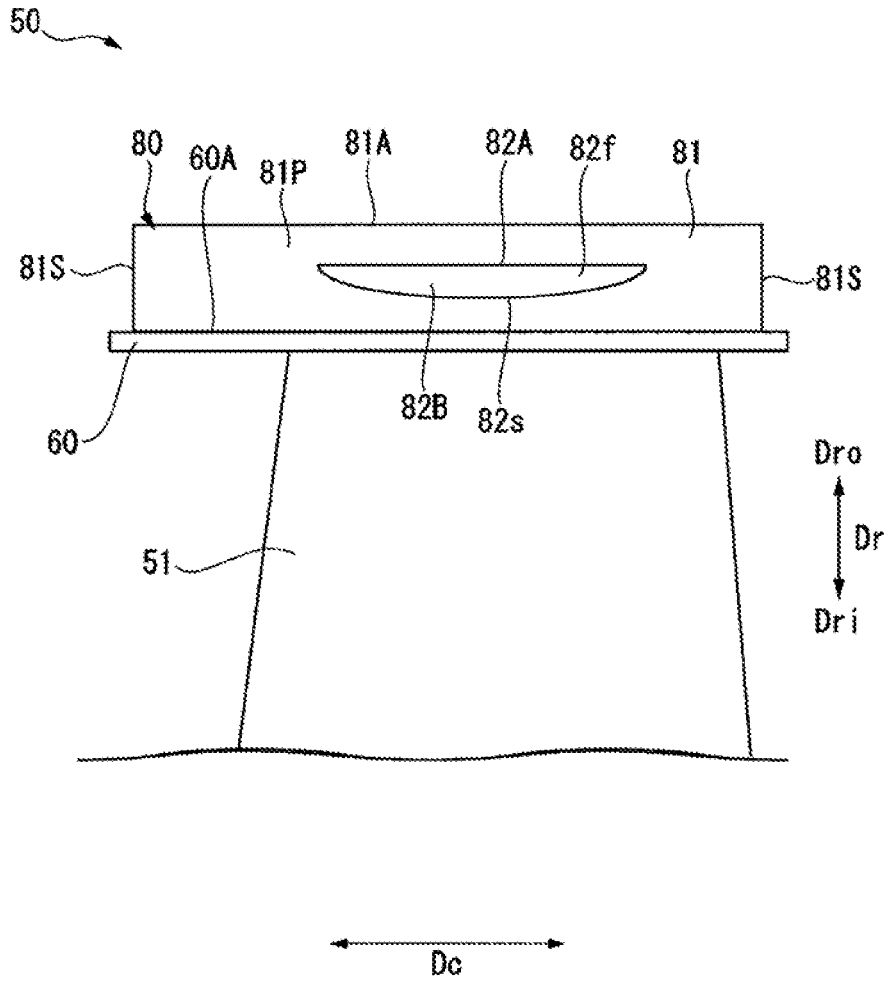
FIG. 9 is a view illustrating a shroud and a seal fin according to a second embodiment of the present disclosure when viewed from the axial direction.
Figure 10:
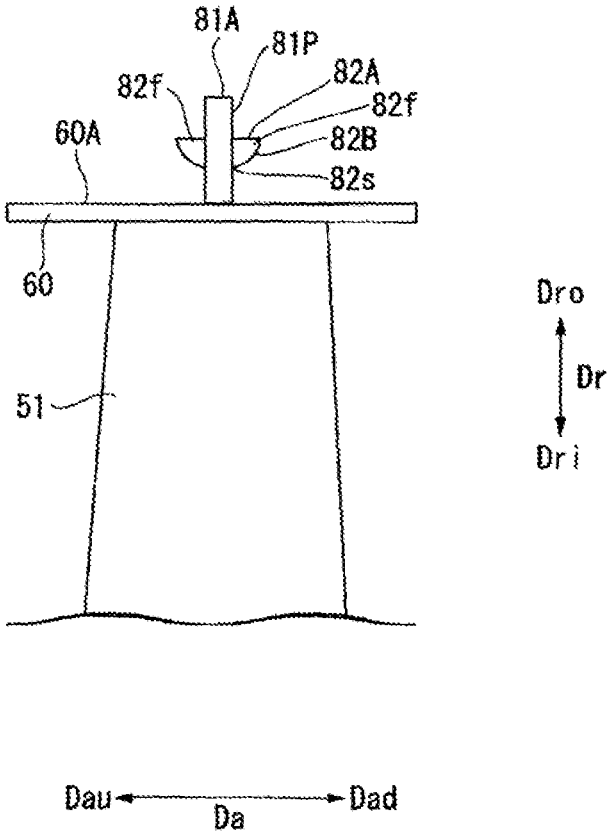
FIG. 10 is a view illustrating the shroud and the seal fin according to the second embodiment of the present disclosure when viewed from the circumferential direction.

Next, a second embodiment of the present disclosure will be described with reference to FIGS. 9 to 11. The same components as those of the first embodiment are denoted by the same reference signs, and a detailed description thereof will be omitted. In the present embodiment, the shape of a reinforcing portion 82*f* is different from those in the first embodiment and the modified examples thereof.

As illustrated in these figures, an end surface (reinforcing portion outer circumferential surface 82A) of the reinforcing portion 82*f* on the radial outer side Dro has a planar shape including the component in the circumferential direction Dc. On the other hand, an end surface (reinforcing portion inner circumferential surface 82B) on the radial inner side Dri is curved so as to protrude toward the radial inner side Dri. In addition, a boundary hug 82*s* between the reinforcing portion inner circumferential surface 82B and the plate surface 81P is curved so as to protrude toward the radial inner side Dri. In other words, the reinforcing portion 82*f* has a half-moon shape that inflates toward the radial inner side Dri.

Figure 11:
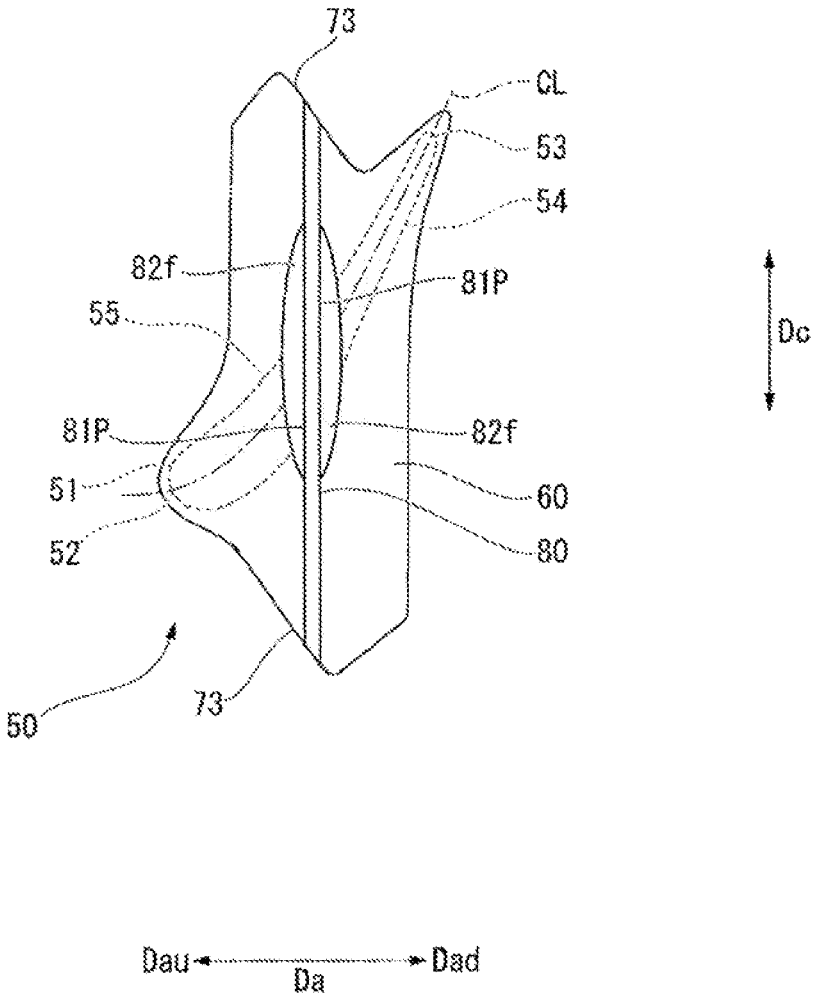
FIG. 11 is a view illustrating the shroud and the seal fin according to the second embodiment of the present disclosure when viewed from the radial outer side.

Furthermore, as illustrated in FIG. 11, as in the fourth modified example of the first embodiment, the thickness of the reinforcing portion 82*f* gradually increases toward the center in the circumferential direction Dc. In other words, the reinforcing portion 82*f* protrudes from the plate surface 81P in a curved shape having an apex at the center in the circumferential direction Dc. In addition, as illustrated in this figure, on both sides of the seal fin body 81 in the thickness direction, the pair of reinforcing portions 82*f* are located at the same position in the circumferential direction Dc. Note that, as in the third modified example of the first embodiment, on both sides of the seal fin body 81 in the thickness direction, the pair of reinforcing portions 82*f* may be located at different positions in the circumferential direction Dc. That is, the portions having the largest dimension (largest portions Mx) in the radial direction Dr in the pair of reinforcing portions 82*f* may intersect the camber line CL of the blade body 51.

With the configuration described above, the thickness of the reinforcing portion 82*f* gradually increases toward the center in the circumferential direction Dc. Thus, the portion of the seal fin 80, where the bending moment is the largest, can be preferentially reinforced to receive most of the bending moment by the reinforcing portion 82*f*. As a result, deformation of the seal fin 80 can be suppressed. In addition, as compared with the configuration in which the thickness of the reinforcing portion 82*f* is constant over the entire range in circumferential direction Dc, the thickness of the reinforcing portion 82*f* can be reduced, thereby suppressing the weight of the entire rotor blade 50. This can reduce the centrifugal force applied to the rotor blade 50, thereby extending the life of the rotor blade.

Furthermore, with the configuration described above, the thickness of the reinforcing portion 82*f* gradually increases toward the radial outer side Dro. Thus, the portion of the seal fin 80, where the bending moment is the largest, can be preferentially reinforced to receive most of the bending moment by the reinforcing portion 82*f*. As a result, deformation of the seal fin 80 can be suppressed. Furthermore, as compared with the configuration in which the thickness of the reinforcing portion 82*f* is constant over the entire range in the radial direction Dr, the thickness of the reinforcing portion 82*f* can be reduced, thereby suppressing the weight of the entire rotor blade 50. This can reduce the centrifugal force applied to the rotor blade 50, thereby extending the life of the rotor blade 50.

The second embodiment of the present disclosure has been described. Note that various changes and modifications can be made to the above-described configuration without departing from the subject matter of the present disclosure. For example, as a modified example common to the embodiments described above, one or a plurality of portions dented toward the radial inner side Dri may be formed on the end surface (reinforcing portion outer circumferential surface 82A) of the reinforcing portion 82 on the radial outer side Dro. As an example, such a dented portion is appropriately designed for the purpose of improving the aerodynamic performance of the rotor blade 50, further improving the structural strength, or avoiding interference with other adjacent members.

Notes

The rotor blade 50 and the axial-flow rotary machine (gas turbine 10) that are described in each embodiment are understood as follows, for example.

(1) A rotor blade 50 according to a first aspect is a rotor blade 50 attached to a rotor shaft 22 rotatable around an axis Ar, the rotor blade including: a blade body 51 extending in a radial direction Dr with respect to the axis Ar, the blade body having a blade-shaped cross section orthogonal to the radial direction Dr, a shroud 60 provided at an end of the blade body 51 on a radial outer side Dro; and a seal fin 80 protruding from the shroud 60 toward an outer circumferential side, wherein the seal fin 80 includes: a seal fin body 81 extending in a plate shape in a circumferential direction; and a reinforcing portion 82 provided on at least one plate surface 81P of the seal fin body 81 so as to increase a thickness of the seal fin 80, the reinforcing portion 82 gradually increasing in dimension in the radial direction Dr toward the center in the circumferential direction Dc.

Here, when the rotor shaft rotates, a centrifugal force toward the radial outer side Dro is applied to the rotor blade 50. Due to the centrifugal force, a bending moment starting from the boundary between the shroud 60 and the blade body 51 toward the radial outer side Dro occurs in the shroud 60. When the bending moment is applied to the seal fin 80, the seal fin 80 may be excessively deformed. However, in the configuration described above, the seal fin body 81 is provided with the reinforcing portions 82. The dimension of the reinforcing portion 82 in the radial direction gradually increases toward the center in the circumferential direction Dc. As a result, the portion of the seal fin 80, where the bending moment is the largest, can be preferentially reinforced to receive most of the bending moment by the reinforcing portions 82. As a result, deformation of the seal fin 80 can be suppressed. Furthermore, as compared with the configuration in which the dimension of the reinforcing portion 82 in the radial direction Dr is constant over the entire range in the circumferential direction Dc, the thickness of the reinforcing portion 82 can be reduced, thereby suppressing the weight of the entire rotor blade 50. This can reduce the centrifugal force applied to the rotor blade 50, thereby extending the life of the rotor blade 50.

(2) In the rotor blade 50 according to a second aspect, a largest portion Mx of the reinforcing portion 82 in the dimension in the radial direction Dr is located at a section where the seal fin 80 and the blade body 51 intersect each other when viewed from the radial direction Dr.

Here, a relatively large bending moment occurs in the section where the shroud 60 and the blade body 51 overlap when viewed from the radial direction Dr, as compared with the other portions. When the bending moment is applied to the seal fin 80, the seal fin 80 may be excessively deformed. However, with the configuration described above, the largest portion Mx of the reinforcing portion 82 is located at the section where the seal fin 80 and the blade body 51 intersect each other. As a result, the portion of the seal fin 80, where the bending moment is the largest, can be preferentially reinforced to receive most of the stress by the reinforcing portions 82. Thus, deformation of the seal fin 80 can be further suppressed.

(3) In the rotor blade 50 according to a third aspect, an end surface (reinforcing portion outer circumferential surface 82A) of the reinforcing portion 82 on the radial outer side Dro is curved so as to protrude toward the radial outer side Dro.

With the configuration described above, the end surface of the reinforcing portion 82 on the radial outer side Dro is curved so as to protrude toward the radial outer side Dro. Thus, the thickness of the reinforcing portion 82 on both ends in the circumferential direction Dc can be reduced. As a result, an increase in weight of the rotor blade 50 due to the reinforcing portion 82 can be suppressed. In addition, since the end surface is curved, for example, as compared with the case where a corner portion is formed on the end surface, localized stress concentration in the reinforcing portion 82 can be suppressed.

(4) In the rotor blade 50 according to a fourth aspect, an end surface of the reinforcing portion 82 on the radial inner side Dri is integrally connected to the surface (shroud outer circumferential surface 60A) of the shroud 60 on the radial outer side Dro.

With the configuration described above, the end surface of the reinforcing portion 82 on the radial inner side Dri is integrally connected to a surface of the shroud 60 on the radial outer side. In other words, the reinforcing portion 82 and the shroud 60 are integrally formed. As a result, the load applied to the shroud 60 due to the centrifugal force can be received more stably.

(5) In the rotor blade 50 according to a fifth aspect, an end surface of the reinforcing portion 82*b* on the radial inner side Dri is opposed to a surface of the shroud 60 on the radial outer side Dro with a gap in the radial direction Dr, and is curved so as to protrude toward the radial inner side Dri.

With the configuration described above, the end surface of the reinforcing portion 82*b* on the radial inner side Dri is curved so as to protrude toward the radial inner side Dri. Thus, the thickness of the reinforcing portion 82*b* on both ends in the circumferential direction Dc can be reduced. As a result, an increase in weight of the rotor blade 50 due to the reinforcing portion 82*b* can be suppressed. In addition, since the end surface is curved, as compared with the case where a corner portion is formed on the end surface, localized stress concentration in the reinforcing portion 82*b* can be suppressed.

(6) in the rotor blade 50 according to a sixth aspect, the dimension of the reinforcing portion 82 in the circumferential direction Dc is smaller than the dimension of the seal fin both 81 in the circumferential direction Dc.

With the configuration described above, the dimension of the reinforcing portion 82 in the circumferential direction Dc is smaller than the dimension of the seal fin body 81 in the circumferential direction Dc. Thus, the thickness of the reinforcing portion 82 on both ends in the circumferential direction Dc can be further reduced. As a result, it is possible to further reduce the increase in weight of the rotor blade 50 due to the reinforcing portion 82.

(7) In the rotor blade 50 according to a seventh aspect, the dimension of the reinforcing portion 82 in the circumferential direction Dc is the same as the dimension of the seal fin body 81 in the circumferential direction Dc.

With the configuration described above, the dimension of the reinforcing portion 82*c* in the circumferential direction is the same as the dimension of the seal fin body 81 in the circumferential direction Dc. As a result, the seal fin body 81 can be stably reinforced over the entire extension length of the seal fin body 81. As a result, excessive deformation of the seal tin 80 can be further suppressed.

(8) In the rotor blade 50 according to an eighth aspect, an end surface of the reinforcing portion 82 on the radial outer side Dro is located closer to the radial inner side Dri than an end face of the seal fin body 81 on the radial outer side Dro.

With the configuration described above, the end surface of the reinforcing portion 82 on the radial outer side Dro is located closer to the radial inner side Dri than the end surface of the seal fin body 81 on the radial outer side Dro. As a result, a portion of the seal fin body 81 on the radial outer side Dro with respect to the reinforcing portion 82 is thinner than the other portion. In other words, the portion functions as a thin cutting blade. Therefore, for example, when an abradable seal (free-cutting material) is brought into contact with the radial outer side of the seal fin body 81, the cutting ability of the seal fin body 81 for the free-cutting material can be further increased. As a result, it is possible to reduce the possibility that the melted free-cutting material adheres to the seal fin body 81, or cutting becomes unstable.

(9) In the rotor blade 50 according to a ninth aspect, the thickness of the reinforcing portion 82*e* gradually increases toward the center in the circumferential direction Dc.

With the configuration described above, the seal fin body 81 is provided with the reinforcing portion 82*e*. The thickness of the reinforcing portion 82*e* gradually increases toward the center in the circumferential direction Dc. Thus, the portion of the seal fin 80, where the bending moment is the largest, can be preferentially reinforced to receive most of the bending moment by the reinforcing portion 82*e*. As a result, deformation of the seal fin 80 can be suppressed. Furthermore, as compared with the configuration in which the thickness of the reinforcing portion 82*e* is constant over the entire range of the seal fin body 81 in the circumferential direction Dc, the thickness of the reinforcing portion 82*e* can be reduced, thereby suppressing the weight of the entire rotor blade 50. This can reduce the centrifugal force applied to the rotor blade 50, thereby extending the life of the rotor blade 50.

(10) In the rotor blade 50 according to a tenth aspect, the thickness of the reinforcing portion 82*f* gradually increases toward the radial outer side Dro.

With the configuration described above, the thickness of the reinforcing portion 82*f* gradually increases toward the radial outer side Dro. Thus, the portion of the seal fin 80, where the bending moment is the largest, can be preferentially reinforced to receive most of the bending moment by the reinforcing portion 82*f*. As a result, deformation of the seal fin 80 can be suppressed. Furthermore, as compared with the configuration in which the thickness of the reinforcing portion 82*f* is constant over the entire range of the seal fin body 81 in the radial direction Dr, the thickness of the reinforcing portion 82*f* can be reduced, thereby suppressing the weight of the entire rotor blade 50. This can reduce the centrifugal force applied to the rotor blade 50, thereby extending the life of the rotor blade 50.

(11) An axial-flow rotary machine (gas turbine 10) according to an eleventh aspect includes the rotor shaft 22; a plurality of rotor blades 50 arranged in the circumferential direction on an outer circumferential surface of the rotor shaft 22, the rotor blades 50 being described in any one of aspects 1 to 10; and a casing (gas turbine casing 15) covering the rotor shaft 22 and the plurality of the rotor blades 50 from the outer circumferential side.

With the configuration described above, the axial flow rotary machine capable of operating more stably can be provided.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A rotor blade attached to a rotor haft rotatable around an axis, the rotor blade comprising:

a blade body extending in a radial direction with respect to the axis, the blade body having a blade-shaped cross section orthogonal to the radial direction;

a shroud provided at an end of the blade body on a radial outer side; and a seal fin protruding from the shroud toward an outer circumferential side, wherein the seal fin includes:

a seal fin body extending in a plate shape in a circumferential direction; and a reinforcing portion provided on at least one of plate surfaces of the seal fin body so as to increase a thickness of the seal fin, the reinforcing portion gradually increasing in dimension in the radial direction toward a center in the circumferential direction.

2. The rotor blade according to claim 1, wherein a largest portion of the reinforcing portion in the dimension in the radial direction is located at a section where the seal fin and the blade body intersect each other when viewed from the radial direction.

3. The rotor blade according to claim 1, herein an end surface of the reinforcing portion on the radial outer side is curved so as to protrude toward the radial outer side.

4. The rotor blade according to claim 1, wherein an end surface of the reinforcing portion on a radial inner side is integrally connected to a surface of the shroud on the radial outer side.

5. The rotor blade according to claim 1, wherein an end surface of the reinforcing portion on the radial inner side is opposed to a surface of the shroud on the radial outer side with a gap in the radial direction, and is curved so as to protrude toward the radial inner side.

6. The rotor blade according to claim 1, wherein a dimension of the reinforcing portion in the circumferential direction is smaller than a dimension of the seal fin body in the circumferential direction.

7. The rotor blade according to claim 1, wherein a dimension of the reinforcing portion in the circumferential direction is the same as a dimension of the seal fin body in the circumferential direction.

8. The rotor blade according to claim 1, wherein an end surface of the reinforcing portion on the radial outer side is located closer to the radial inner side than an end face of the seal fin body on the radial outer side.

9. The rotor blade according to claim 1, wherein a thickness of the reinforcing portion gradually increases toward the center in the circumferential direction.

10. The rotor blade according to claim 1, wherein a thickness of the reinforcing portion gradually increases toward the radial outer side.

11. An axial-flow rotary machine comprising:

the rotor shaft;

a plurality of the rotor blades arranged in the circumferential direction on an outer circumferential surface of the rotor shaft, the rotor blades being described in claim 1; and a casing covering the rotor shaft and the plurality of the rotor blades from the outer circumferential side.

* * * * *